US007475795B2

(12) United States Patent
Faller et al.

(10) Patent No.: US 7,475,795 B2
(45) Date of Patent: Jan. 13, 2009

(54) CHILLED TOPPING DISPENSER

(75) Inventors: James Faller, Williamsville, NY (US); Christopher V. Tirone, East Aurora, NY (US); Avery Wilson, Middle Sackville, CA (US); Gregory Erman, Head of Chezzetcook, CA (US); David Ricker, Fall River, CA (US)

(73) Assignee: Rich Products Corporation, Buffalo, NY (US)

( * ) Notice: Subject to any disclaimer, the term of this patent is extended or adjusted under 35 U.S.C. 154(b) by 0 days.

(21) Appl. No.: 11/846,143

(22) Filed: Aug. 28, 2007

(65) Prior Publication Data

US 2008/0073374 A1 Mar. 27, 2008

Related U.S. Application Data

(60) Provisional application No. 60/841,064, filed on Aug. 30, 2006.

(51) Int. Cl.
*B65D 35/28* (2006.01)

(52) U.S. Cl. ..... 222/95; 222/101; 222/105; 222/129.1; 222/146.6; 222/325; 222/326; 222/333; 222/494

(58) Field of Classification Search ..... 222/94–95, 222/333, 100–103, 325–327, 386, 129.1, 222/491, 494, 146.5, 105, 181.2, 209, 181.3, 222/212, 213–215, 181.1, 63, 146.6
See application file for complete search history.

(56) References Cited

U.S. PATENT DOCUMENTS 2,533,839 A * 12/1950 Robinson ..... 222/103
4,349,133 A * 9/1982 Christine ..... 222/183
5,215,218 A * 6/1993 Choi ..... 222/63
5,697,252 A * 12/1997 Yamaguchi et al. ..... 74/441
5,803,317 A * 9/1998 Wheeler ..... 222/214
5,845,813 A * 12/1998 Werner ..... 222/101
5,875,929 A * 3/1999 Nguyen ..... 222/102
6,196,420 B1 * 3/2001 Gutierrez et al. ..... 222/101
6,345,734 B2 * 2/2002 Schalow et al. ..... 222/103
6,662,971 B1 * 12/2003 Nguyen et al. ..... 222/101
6,691,894 B2 * 2/2004 Chrisman et al. ..... 222/101
7,007,824 B2 * 3/2006 Danby et al. ..... 222/103

* cited by examiner

*Primary Examiner*—Frederick C. Nicolas
(74) *Attorney, Agent, or Firm*—Hodgson Russ LLP

(57) ABSTRACT

A topping dispenser for dispensing portions of chilled topping onto beverages and desserts comprises a housing having a drawer that includes a product compartment and an adjacent drive compartment separated by a partition. The product compartment is adapted to receive a bag containing topping, and houses a vertically displaceable pressure member, such as a roller, to roll down along one side of the bag opposite a pressure surface on the other side of the bag to squeeze contents of the bag out through a bottom dispensing valve assembly to direct product into a waiting container. The roller is advanced downward in predetermined increments by a motor-driven carriage assembly in the drive compartment that may be actuated by a push button on the housing. The dispensing valve assembly holds a pressure-actuated valve that closes automatically to cleanly cut off a dispensed ribbon of topping and is configured to impart a decorative appearance to the dispensed ribbon. An alternative embodiment uses a piston and cylinder to force product from the bag.

23 Claims, 7 Drawing Sheets

Fig. 8
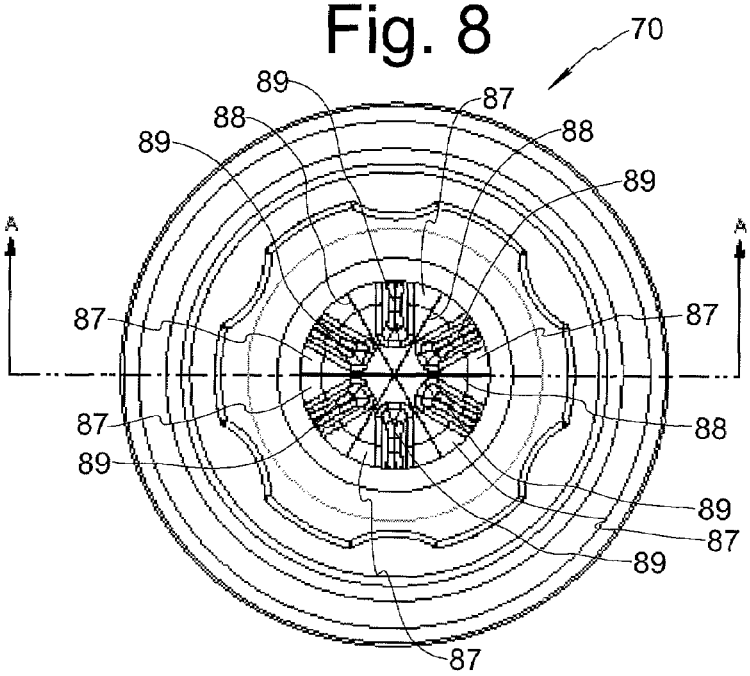
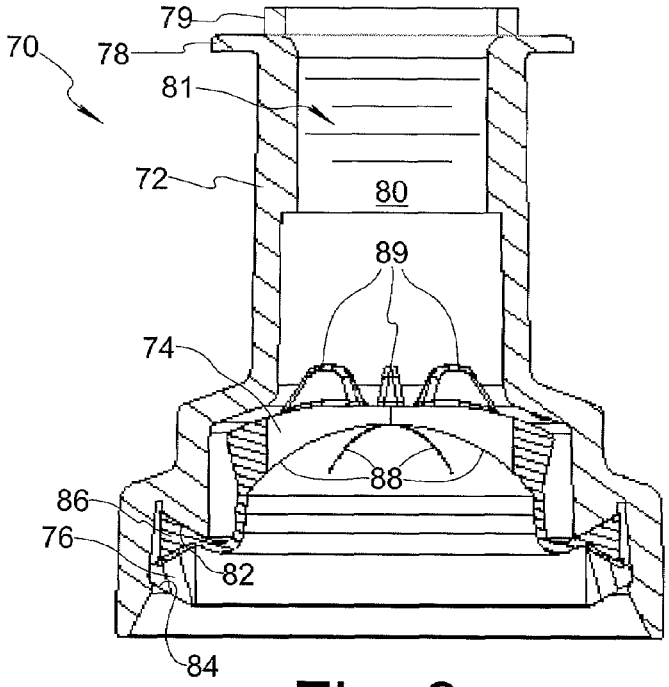
Fig. 9
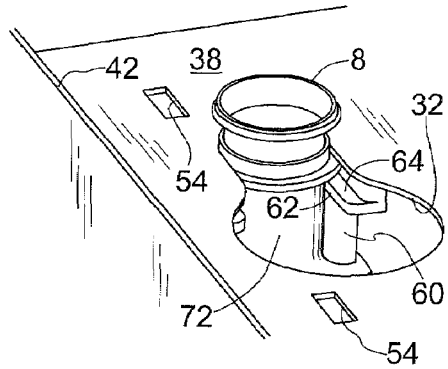
Fig. 10

CHILLED TOPPING DISPENSER

CROSS-REFERENCE TO RELATED APPLICATIONS

This application claims the benefit of U.S. Provisional Patent Application No. 60/841,064 filed on Aug. 30, 2006, which is incorporated by reference herein.

FIELD OF THE INVENTION

The present invention relates generally to dispensing machines for food products, and more particularly to a self-serve dispensing machine for dispensing serving portions of refrigerated toppings and the like from a plastic bag container. The invention is useful for applying chilled toppings to hot or cold coffee, desserts, shakes, iced cappuccinos, and frozen drinks.

BACKGROUND OF THE INVENTION

A chilled topping dispenser is needed having the following characteristics:

- it accepts commercially available prepackaged bags of topping or other product;
- it refrigerates the product to be dispensed;
- it is adapted for easy and clean loading of full product bags and unloading of emptied product bags;
- it is easily operated and may be self-serve for consumers;
- it dispenses consistently-sized serving portions;
- it fully evacuates the product bag to minimize product waste;
- it is compact so as to occupy very little counter space; and
- it is mechanically simple and dependable.

SUMMARY OF THE INVENTION

The present invention provides a chilled topping dispenser for use with a bag containing product to be dispensed. A dispenser formed in accordance with an embodiment of the invention comprises a housing defining a product compartment for receiving the bag, the housing including a dispensing port communicating with the product compartment; a dispensing valve assembly including a pressure-actuated dispensing valve aligned with the dispensing port of the housing, the dispensing valve assembly being adapted for coupling a dispensing tip of the bag thereto; a pressure member such as a roller in the product compartment; a pressure surface proximate to the pressure member; and a carriage assembly connected to the pressure member for supporting and moving the pressure member relative to the pressure surface, the carriage assembly including a carriage and an electric motor operable to displace the carriage relative to the pressure surface; wherein movement of the pressure member relative to the pressure surface forces product from the bag and through the dispensing valve.

In accordance with an embodiment of the invention, a refrigeration system is provided for regulating temperature within the product compartment, and the product compartment is provided on a drawer that pulls out of a main body of the dispenser housing. A removable panel may be provided to permit access to the product compartment for reloading the dispenser, and such panel may also define the pressure surface.

The carriage assembly may include a pair of guide rods and a threaded rod extending vertically in a drive compartment located adjacent the product compartment, with the carriage being mounted on the guide rods and threaded rod for travel therealong. Carriage movement may be driven by a motor mounted to the carriage and having a captive, internally-threaded rotor mated with the threaded rod.

The dispensing valve assembly may include a valve housing removably mounted on an underside of the drawer for accommodating the pressure-actuated dispensing valve. The valve housing may be adapted to receive and couple to the dispensing tip of the product bag. The valve housing may be removably mounted on an underside of the drawer by a collar member. The pressure-actuated dispensing valve may include a plurality of deflectable fingers each having a protrusion thereon arranged to protrude into the flow path to form decorative ridges along a discharged ribbon of topping.

BRIEF DESCRIPTION OF THE DRAWINGS

The nature and mode of operation of the present invention will now be more fully described in the following detailed description of the invention taken with the accompanying drawing figures, in which:

FIG. 8 is an enlarged top plan view of a dispensing valve assembly of the dispenser;

FIG. 9 is an enlarged sectional view of the dispensing valve assembly taken generally along the line A-A in FIG. 8; and FIG. 10 is a perspective view showing how the dispensing valve assembly is mounted on the drawer of the dispenser.

DETAILED DESCRIPTION OF THE INVENTION

Figure 1:
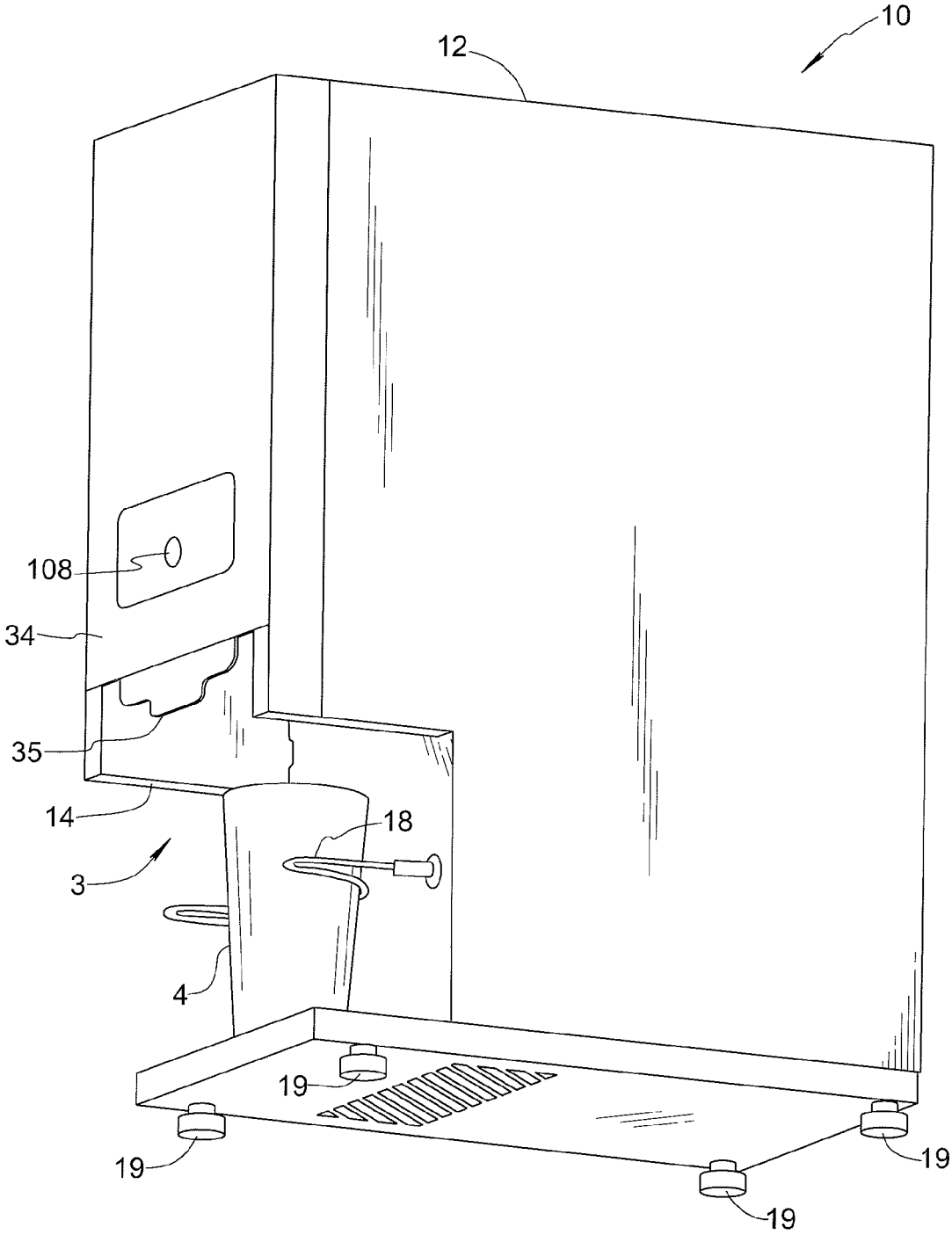
FIG. 1 is a perspective view of a topping dispenser formed in accordance with an embodiment of the present invention.
Figure 2:
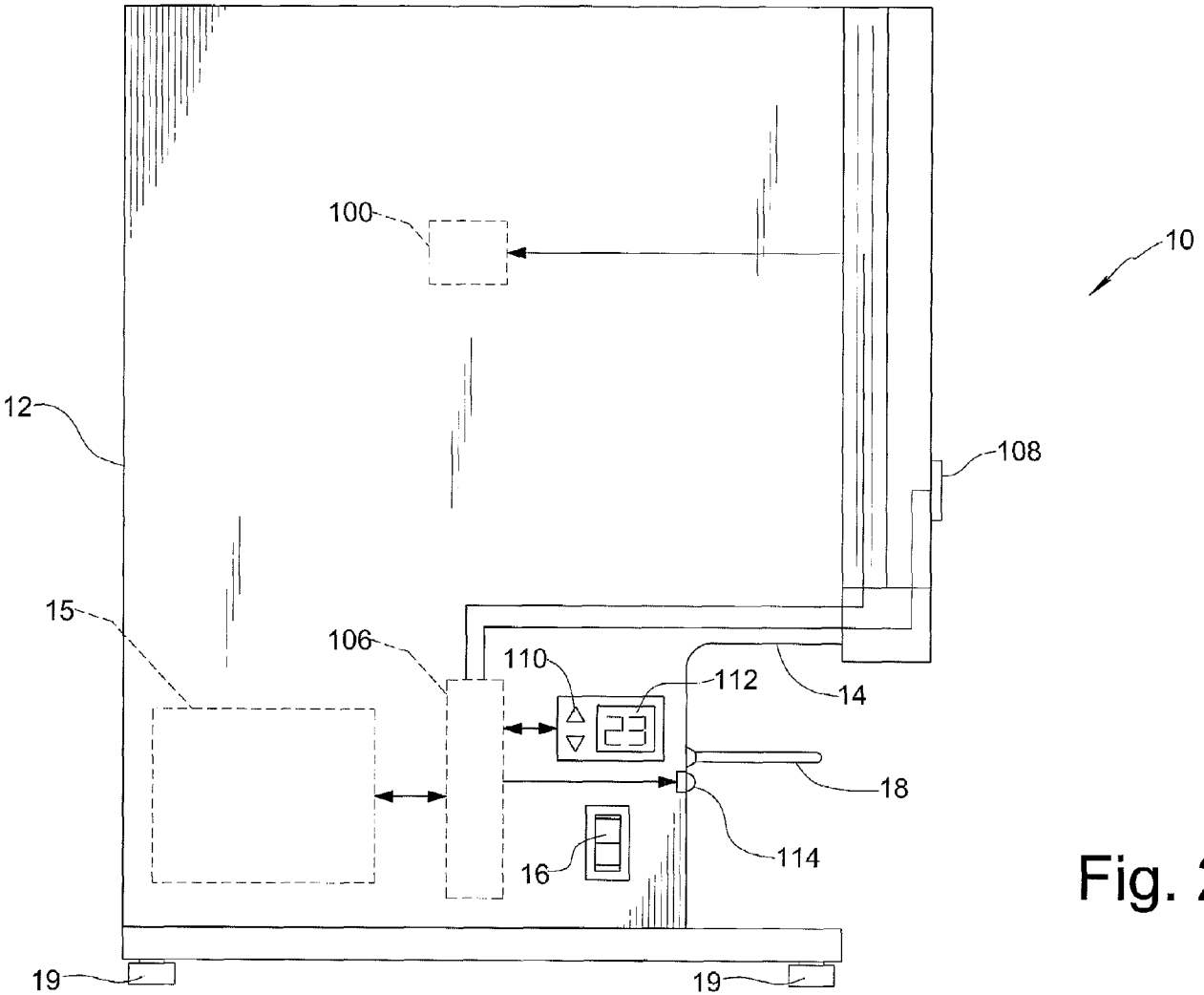
FIG. 2 is a left-side elevational view of the topping dispenser shown in FIG. 1.

A topping dispenser formed in accordance with an embodiment of the present invention is shown in FIGS. 1 and 2, and is identified generally by reference numeral 10. Topping dispenser 10 comprises a housing 12 having a cantilevered front portion 14 defining an open space 3 for receiving a user's cup, glass, mug, or other serving container 4 into which topping product may be dispensed. Dispenser 10 is intended to serve a portion of a topping product, such as chilled whipped topping, onto beverages, desserts, and the like. Dispenser 10 receives electrical power through a standard power cord (not shown) connected to an AC power outlet, and a power switch 16 is provided externally on housing 12 for turning power to dispenser 10 on and off. A wire cup brace 18 may be arranged to extend from housing 12 to guide user placement of serving container 4 and help stabilize the serving container during a dispensing operation. Housing 12 may be provided with feet or suction cups 19 to prevent the dispenser from sliding on a countertop or other support surface. Housing 12 may be formed of a material that withstands moisture and is easily cleaned, such as stainless steel, plastic, ceramic, or the like.

Reference is also made now to FIGS. 3-6. Housing 12 includes a main body 20 and a drawer 22 mounted on main body 20 by drawer slides 24 so as to be movable into and out of the main body 20. Housing 12 defines a product compartment 26 (FIG. 5) for receiving a plastic bag 5 filled with whipped topping or other product to be dispensed, and a drive compartment 28 for enclosing a carriage assembly 30 as will be described in detail below. Product compartment 26 and drive compartment 28 may be associated with drawer 22 so that access to the compartments may be gained by opening drawer 22. Housing 12 further includes a dispensing port 32 enabling flow communication between product compartment 26 and open space 3.

In the embodiment shown, dispenser 10 includes a refrigeration system 15 located in a bottom portion of housing main body 20, as indicated schematically in FIG. 2. Refrigeration system 15 regulates temperature within housing 12, including product compartment 26, to keep topping within bag 5 properly chilled. In this regard, the walls of housing main body 20, and a front wall 34 of drawer 22, may be thermally insulated for energy efficiency. A peripheral seal 36 is preferably provided on front wall 34 to form a seal between front wall 34 and main body 20 when drawer 22 is in a closed position. A handle 35, visible in FIG. 1, may be provided on drawer front wall 34.

Drawer 22 is depicted as having a bottom wall 38, a side wall 40 and a truncated side wall 42 extending upwardly from opposite sides of bottom wall 38, a front flange 43 extending from a front end of truncated side wall 42, a truncated front wall 44 and a truncated rear wall 46 extending from opposite ends of side wall 40 to enclose drive compartment 28, and a top wall 48 extending from side wall 40 to cover drive compartment 28 and product compartment 26. The walls 38, 40, 42, 44, 46, and 48, and flange 43, may be formed from a single piece of sheet metal using known manufacturing forming methods. Flange 43 and truncated front wall 44 provide structure to which front wall 34 may be fastened. A partition 50 is provided between drive compartment 28 and product compartment 26, and a panel 52 is provided on an opposite side of product compartment 26 from partition 50. Panel 52 may be removably mounted on drawer 22, for example by insertion of tabs 53 provided along a bottom edge of the panel into corresponding slots 54 formed in bottom wall 38, and by insertion of tabs 55 provided along an edge of top wall 48 into corresponding slots 56 in panel 52. Other means of removably mounting panel 52 on drawer 22 may be employed, for example toggle latches, snap fittings, pins, threaded fasteners, or the like. A plurality of hang tabs 58 may be spaced along the underside of top wall 48 for use in suspending product bag 5 within product compartment 26, or tabs 55 may be used for hanging the product bag.

Attention is directed additionally to FIGS. 8-10. Dispensing port 32 may be configured as a dual size opening through bottom wall 38 of drawer 22. A slotted collar member 60 may be fixed to the underside of bottom wall 38 beneath the smaller open portion of dispensing port 32 to receive and support a valve assembly 70 for controlling the flow of topping from bag 5 and imparting a decorative appearance to each ribbon of topping that is dispensed through the valve assembly. In the embodiment shown, valve assembly 70 includes a valve housing 72, a discharge valve 74 received within valve housing 72, and a retaining ring 76 for securing the discharge valve within the valve housing. Valve housing 72 includes a circumferential flange 78 near a top end thereof, a neck 79 above flange 78, an axial passage 80 therethrough having an upper threaded portion 81, and an abutment ring 82 and a retaining ridge 84 formed on a wall of passage 80 near a bottom end of valve housing 72. Discharge valve 74, which may be manufactured of a resiliently deformable material, such as silicone, includes a seating flap 86 and a plurality of fingers 87 defined by a plurality of slits 88. As may be seen, seating flap 86 may be confined against abutment ring 82 in valve housing 72 by retaining ring 76, which in turn may be snap fitted into valve housing 72 and held against retaining ridge 84. Slits 88 allow discharge valve 74 to perform as an automatically closing pressure valve, whereby the valve fingers 87 will deflect open as topping under pressure is forced downward through passage 80, and will close immediately when the pressure decreases. In this way, a clean cut-off of the topping ribbon is achieved, and residual topping portions hanging from the bottom of valve assembly 70 (so-called "danglers") are substantially eliminated. A suitable discharge valve may be obtained from Liquid Molding Systems, Inc. of Midland, Mich. under the trademark SUREFLO®. In accordance with an embodiment of the present invention, a plurality of projections 89 may be provided on fingers 87 such that when discharge valve 74 is forced open and fingers 87 are deflected, the projections 89 protrude into the flow path of the topping to form decorative ridges along the discharged ribbon of topping for a pleasing appearance.

As may be seen in FIG. 10, valve assembly 70 may be mounted on the underside of drawer 22 adjacent dispensing port 32 by collar member 60. In the illustrated embodiment, collar member 60 includes a slot 62 open in the direction of the larger open portion of dispensing port 32, and a shelf 64 surrounding the slot. As may be understood, valve housing 72 may be inserted downward through the larger open portion of dispensing port 32 and then valve housing 72 may be slid forward toward the smaller open portion of dispensing port 32 and into slot 62 until flange 78 is confined between shelf 64 and the underside of bottom wall 38. In this manner, valve assembly 70 may be mounted on drawer 22 for easy removal to facilitate cleaning and replacement of the valve assembly or any constituent parts of the valve assembly.

Figure 3:
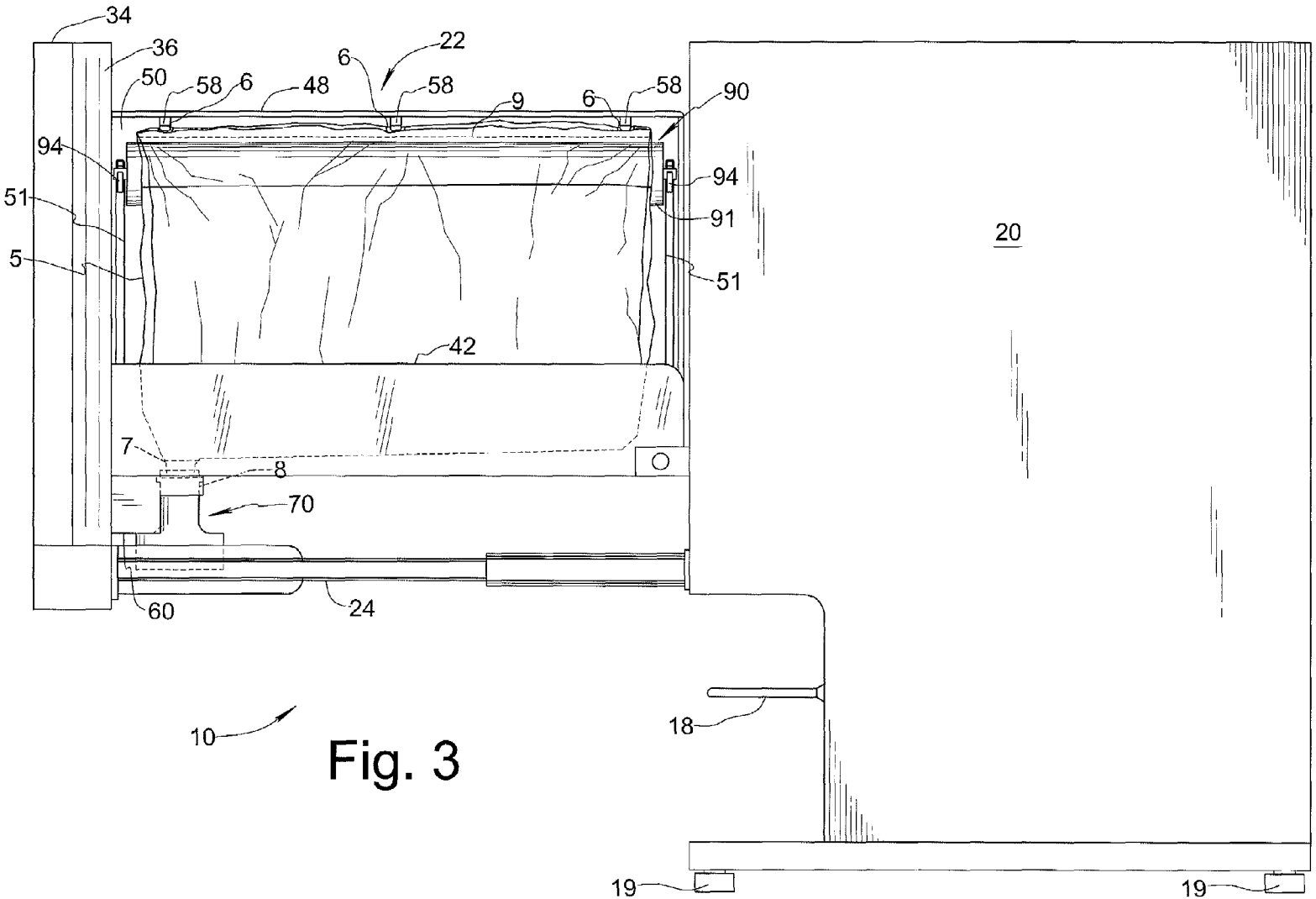
FIG. 3 is a right side elevational view thereof, with a drawer of the dispenser being shown in an opened position and a panel of the dispenser removed to reveal a product bag suspended within a product compartment associated with the drawer.
Figure 4:
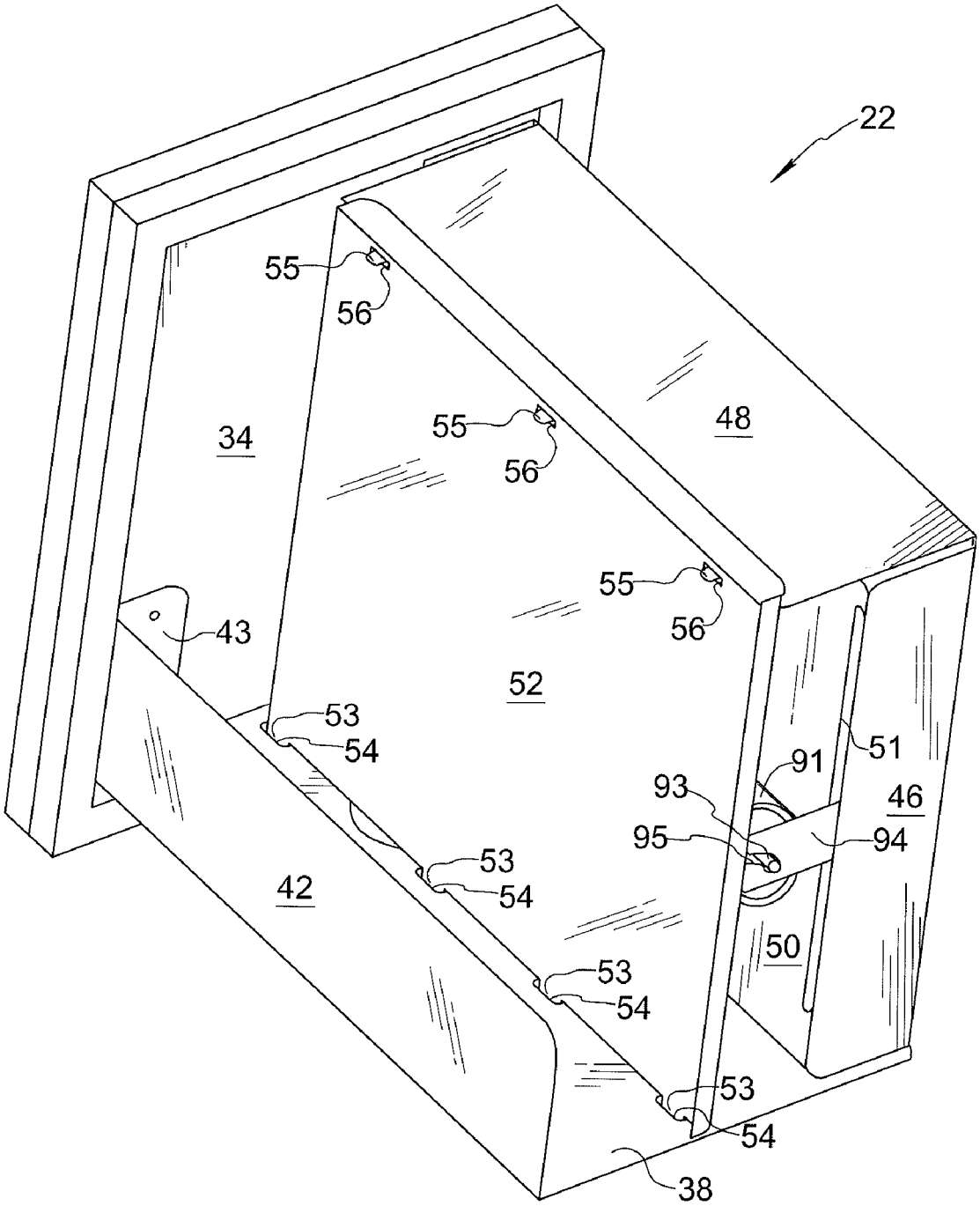
FIG. 4 is a perspective view of the drawer.
Figure 5:
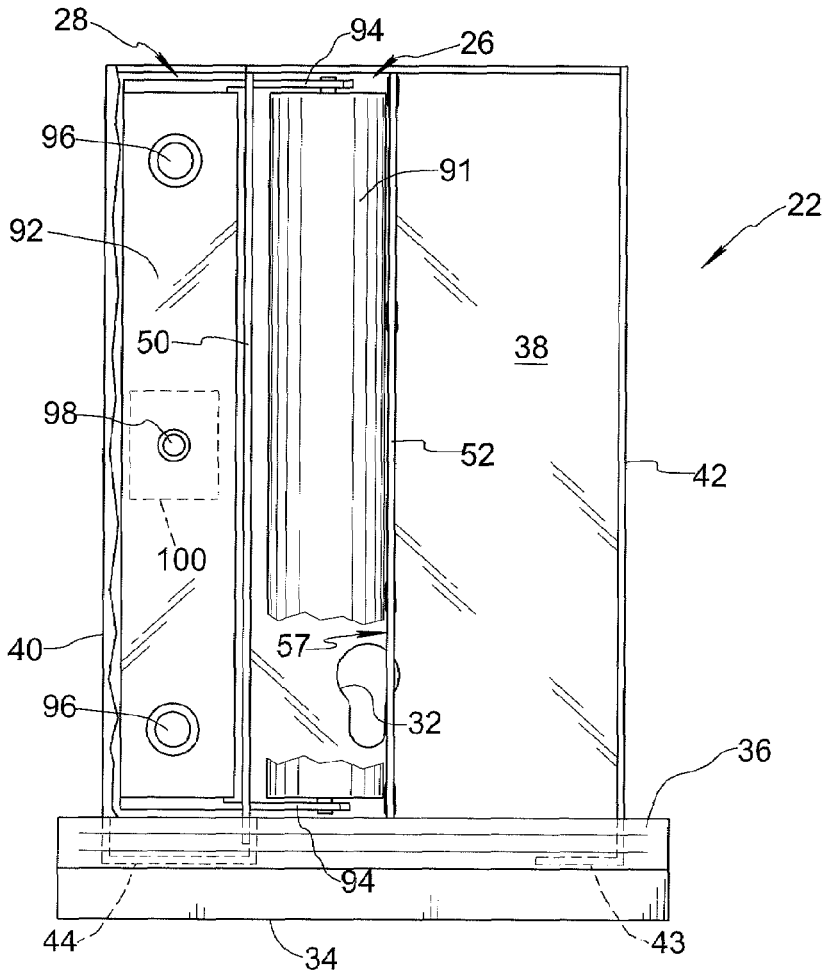
FIG. 5 is a top plan view of the dispenser drawer, with a top wall of the drawer cut away to reveal a drive compartment and the product compartment associated with the drawer.
Figure 6:
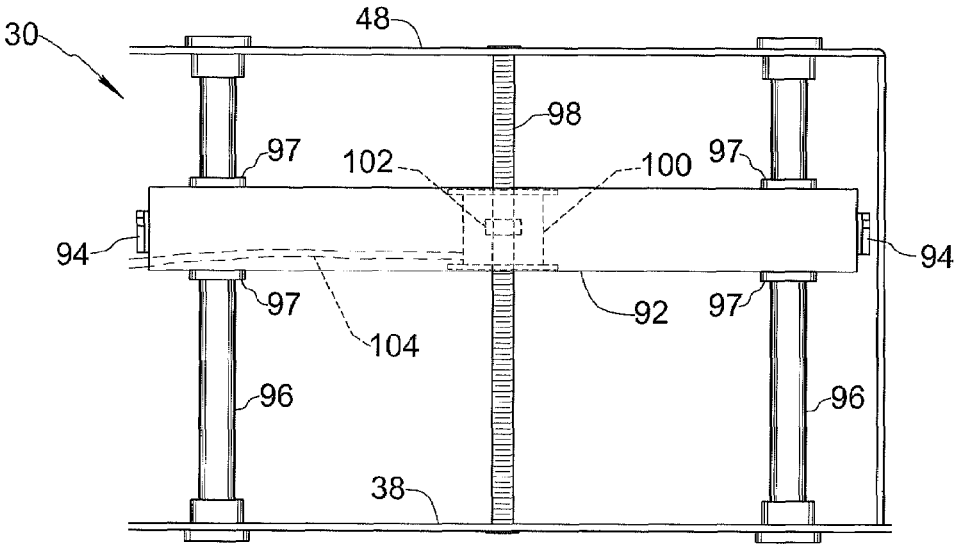
FIG. 6 is an elevational view of a carriage assembly of the dispenser.

Product bag 5 may have a generally rectangular configuration as shown in FIG. 3 so as to fit within product compartment 26 and substantially occupy the available space. Bag 5 may have a top marginal portion above an upper seam 9 of the bag, and a plurality of holes 6 may be provided through the marginal portion for respectively receiving hang tabs 58 on top wall 48 to suspend product bag 5 within product compartment 26 as shown in FIG. 3 (topping product remains below seam 9 as seen in FIG. 3). Of course, alternatives for suspending bag 5 may be used, such as clamps or clips. Bag 5 includes a neck portion 7 at a bottom corner thereof terminating in a dispensing tip 8 adapted for detachable connection with valve housing 72. In the embodiment described at present, dispensing tip 8 may be threaded to mate with threaded portion 81 of passage 80. Other detachable connection schemes may be used, including for example snap-fittings and frictional attachment arrangements. Dispensing tip 8 may be connected to valve housing 72 before the valve housing is inserted downward into dispensing port 32.

In order to force contents from product bag 5, a pressure member 90 is arranged in product compartment 26, and a pressure surface 57, which may be a surface of removable panel 52, is provided closely proximate to pressure member 90. When product bag 5 is loaded into product compartment 26, the bag resides between pressure member 90 on one side and pressure surface 57 on an opposite side. As will be described below, pressure member 90 is movable relative to pressure surface 57 to squeeze product downward under pressure. In the embodiment shown in the figures, pressure member 90 is in the form of a cylindrical roller 91 positioned to rotate about a horizontal axis, however non-roller configurations are possible, including for example a plow or scraper configuration having a generally horizontal edge. For the remainder of this detailed description, a roller configuration is assumed, it being understood that pressure member 90 may have other configurations. It is advantageous, but not necessary, that either the surface of pressure member 90 or pressure surface 57 of panel 52 be resiliently deformable, and the other rigid, to ensure continuous contact between pressure member 90, bag 5, and pressure surface 57, thereby maximizing evacuation of product from bag 5. For example, roller 91 may have a foam or rubber exterior, and panel 52 may simply be a rigid portion of sheet metal. However, pressure member 90 and pressure surface 57 may both be rigid without straying from the invention.

As mentioned above, a carriage assembly 30 is housed within drive compartment 28. Carriage assembly 30, best shown in FIG. 6, includes a carriage 92 elongated in a horizontal direction and having a pair of journal arms 94 which extend from opposite ends of the carriage through travel slots 51 in partition 50 and into product compartment 26. Each journal arm 94 includes an open journal slot 95 for receiving a respective hub member 93 of roller 91 to removably support roller 91 for rotation about its horizontal axis. Carriage assembly 30 further includes a pair of guide rods 96 and a threaded rod 98 extending parallel to one another, carriage 92 being mounted on the guide rods and threaded rod for travel therealong. Movement of carriage 92 is driven by a motor 100. Motor 100 may be mounted directly on carriage 92 and be of a type having a captive, internally-threaded rotor 102 that may be mated with threaded rod 98, such that when the motor is energized to rotate the rotor 102, the motor 100 and carriage 92 coupled thereto will travel up or down threaded rod 98 depending upon the direction of rotation of the rotor. A suitable motor having a captive, internally threaded rotor for travel along a stationary threaded rod is available from Haydon Switch and Instrument, Inc. of Waterbury, Conn. Guide rods 96 are slidably received through bushings 97 on carriage 92.

Figure 7:
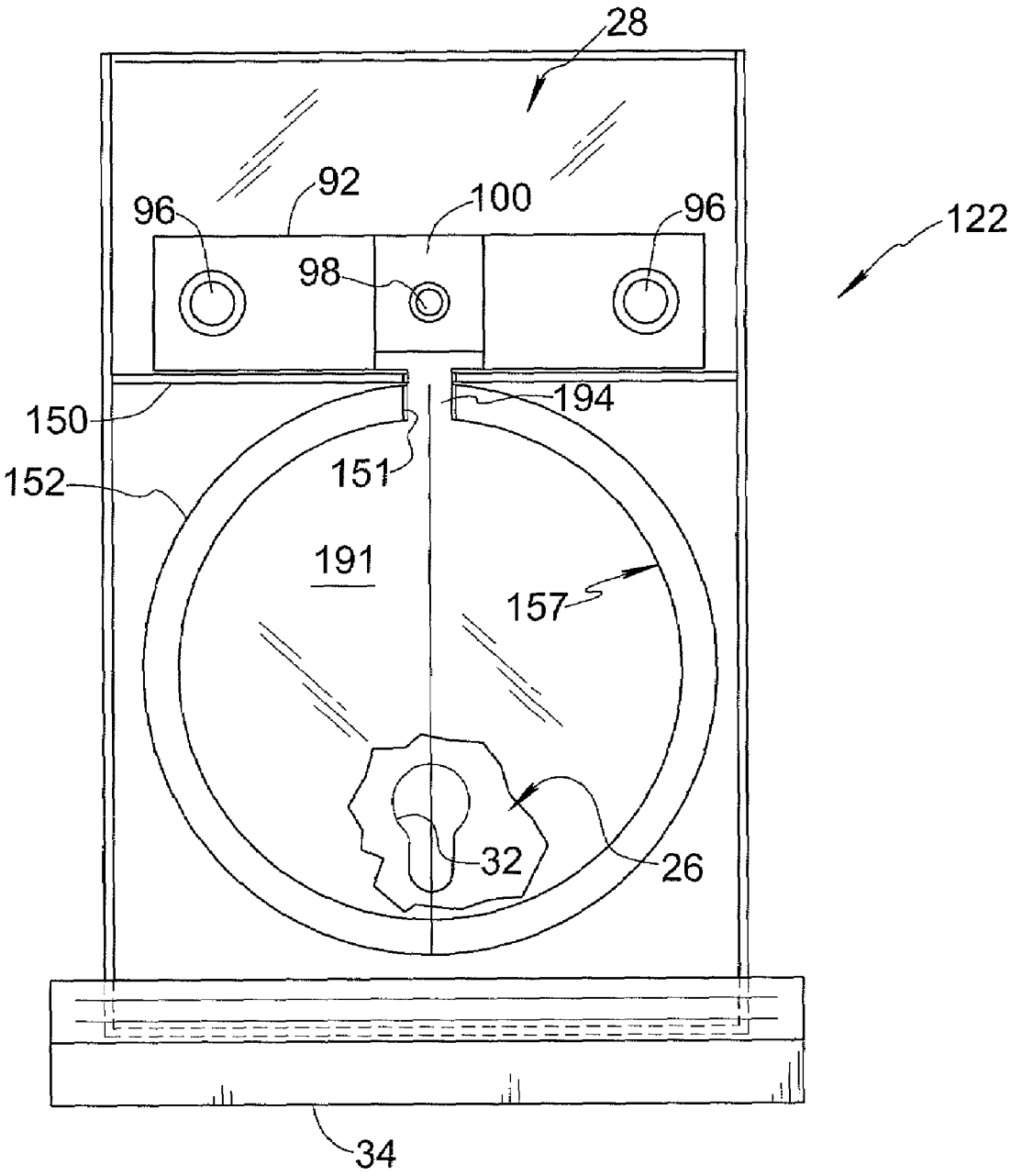
FIG. 7 is a top plan view of a dispenser drawer formed in accordance with an alternative embodiment of the present invention, with a top wall of the drawer omitted to reveal a drive compartment and a product compartment associated with the drawer.

FIG. 7 depicts a drawer 122 formed in accordance with an alternative embodiment of the present invention, wherein product compartment 26 is defined by a cylinder 152 at a front portion of the drawer and separated from drive compartment 28 by a transverse partition 150 having a vertical travel slot 151 therethrough. A piston 191 is connected to carriage 92 to serve as the pressure member, and an inner wall 157 of cylinder 152 serves as a pressure surface. Piston 191 is shown partially cut away to reveal dispensing port 32. Inner wall 157 may be sloped to converge in conical fashion (not shown) at a region near dispensing port 32. Carriage 92 is connected to piston 191 through arm 194 extending through travel slot 151, whereby piston 191 may be moved relative to cylinder wall 157 by operation of motor 100. If this embodiment is practiced, bag 5 may be generally cylindrical in shape to fill the available space within the product compartment.

Returning now to FIG. 6, electrical wiring for motor 100 may be routed through a cable 104 running through carriage 92 and then along an underside of drawer 22 to control electronics 106 mounted within housing main body 20 and connected to a power source (not shown) also within the main body. Control electronics 106 includes a motor controller and driver for energizing motor 100. A user control element, shown here for example in the form of a push button 108 on front wall 34, is connected to the motor controller for enabling a user to activate motor 100 via the motor controller. The motor controller may be programmed to drive motor 100 to achieve a predetermined displacement of carriage 92 and roller 91 when button 108 is pressed and released by a user. Alternatively, the motor controller may be programmed to drive the motor only while button 108 is depressed by a user. If the latter approach is adopted, it may be desirable to program the motor controller to shut the motor off after a predetermined time period or number of revolutions so as to prevent a user from dispensing too much topping.

Those skilled in the art will recognize that other motor drive configurations are possible, including configurations wherein the motor 100 does not travel with carriage 92. For example, a motor may be mounted remote from carriage 92 to rotate threaded rod 98, and carriage 92 may be provided with a follower nut causing the carriage to travel up and down the rotating threaded rod. Also, it will be readily apparent that other user control elements, such as a switch, a lever, a knob, or the like, may be substituted for push button 108.

In addition to push button 108, other user controls connected to control electronics 106 may be provided on housing 12, including a temperature control 110 and a temperature display 112 for regulating refrigeration system 15, and a status indicator LED 114 for indicating that dispenser 10 is ready to dispense, low on product, emptied of product, or out of service. A reset button (not shown) may be provided to return the carriage 92 and roller 91 to an upper start position. Housing 12 may be a customized version of a refrigerated liquid dispenser available from A.C. Dispensing Equipment Inc. of Sackville, Nova Scotia, Canada under the trademark SURESHOT.

Dispenser 10 is simple to use. Initially, drawer 22 is opened and panel 52 is removed to expose product compartment 26. Roller 91 is set to an upper start position (this may be triggered automatically upon emptying a prior bag, or a reset button may be provided as mentioned above). An empty bag (if any) is removed, and a full bag 5 is inserted into product compartment 26, where its discharge tip 8 is connected to valve housing 72 and the bag is suspended from hang tabs 58 or tabs 55. The valve housing 72 may then be mounted on drawer 22 as described above, panel 52 may be replaced, and drawer 22 may be closed. Refrigeration system 15 may be set to a desired temperature setting using temperature control 110. The alternative embodiment of FIG. 7 may be loaded in an analogous manner.

For self-service of topping, a cup or other container 4 is located in space 3 beneath valve assembly 70 using wire brace 18 as a locating guide. Button 108 is depressed to move carriage 92 and roller 91 (or piston 191) downward to force product from bag 5, through valve assembly 70, and into container 4.

When the contents of bag 5 have been exhausted, roller 91 (or piston 191) may be reset and the bag replaced as described above.

While the invention has been described in connection exemplary embodiments, the detailed description is not intended to limit the scope of the invention to the particular forms set forth. The invention is intended to cover such alternatives, modifications, and equivalents of the described embodiment as may be included within the spirit and scope of the invention.

What is claimed is:

1. A dispenser for use with a bag containing the product to be dispensed, the bag including a dispensing tip through which product is dispensed, the dispenser comprising:

a housing defining a product compartment for receiving the bag, the housing including a dispensing port communicating with the product compartment;

a dispensing valve assembly including a pressure-actuated dispensing valve aligned with the dispensing port of the housing, the dispensing valve assembly being adapted for coupling the dispensing tip of the bag thereto;

a pressure member in the product compartment;

a pressure surface proximate to the pressure member; and a carriage assembly connected to the pressure member for supporting and moving the pressure member relative to the pressure surface, the carriage assembly including a carriage and an electric motor operable to displace the carriage relative to the pressure surface;

wherein movement of the pressure member relative to the pressure surface forces the product from the bag and through the dispensing valve.

2. The dispenser according to claim 1, further comprising a refrigeration system for regulating temperature within the product compartment.

3. The dispenser according to claim 1, wherein the housing includes a main body and a drawer movable into and out of the main body, and the product compartment is associated with the drawer.

4. The dispenser according to claim 3, wherein the housing further includes a drive compartment associated with the drawer adjacent the product compartment, and the carriage is arranged substantially in the drive compartment.

5. The dispenser according to claim 3, wherein the pressure surface is located on a panel removably attached to the drawer.

6. The dispenser according to claim 5, wherein the panel includes a plurality of tabs extending from a bottom edge thereof, and the drawer includes a bottom wall having a plurality of slots arranged to receive the plurality of tabs of the panel.

7. The dispenser according to claim 5, wherein the drawer includes a top wall and a plurality of tabs extending from the top wall, and the panel includes a plurality of slots arranged to receive the plurality of tabs of the top wall.

8. The dispenser according to claim 3, where the drawer includes a top wall and a plurality of hang tabs supported on the top wall for suspending the bag in the product compartment.

9. The dispenser according to claim 1, wherein one of the pressure member and the pressure surface is resiliently deformable, and the other of the pressure member and the pressure surface is rigid.

10. The dispenser according to claim 1, wherein the pressure member is a roller.

11. The dispenser according to claim 1, wherein the pressure member is a plow member.

12. The dispenser according to claim 1, wherein the pressure member is a piston and the product compartment is configure as a cylinder.

13. The dispenser according to claim 1, wherein the carriage assembly includes a pair of guide rods and a threaded rod extending parallel to one another, the carriage being mounted on the guide rods and threaded rod for travel therealong.

14. The dispenser according to claim 13, wherein the motor is mounted on the carriage for travel therewith and includes a threaded rotor mated with the threaded rod.

15. The dispenser according to claim 1, further comprising a motor controller connected to the motor for providing drive commands to the motor, and a user control element connected to the motor controller for enabling a user to activate the motor via the motor controller.

16. The dispenser according to claim 15, wherein the control element is a push button, and the motor controller is programmed to drive the motor to achieve a predetermined displacement of the carriage and pressure member when the button is pressed and released.

17. The dispenser according to claim 15, wherein the control element is a push button, and the motor controller is programmed to drive the motor only while the push button is depressed.

18. The dispenser according to claim 3, wherein the dispensing valve assembly further includes a valve housing removably mounted on an underside of the drawer, the valve housing receiving the pressure-actuated dispensing valve, wherein the valve housing is adapted for coupling the dispensing tip of the bag thereto.

19. The dispenser according to claim 18, wherein the valve housing has an upper flange, and the drawer includes a collar member attached to a bottom wall thereof, the collar member having a slot sized to receive an upper end of the valve housing and a shelf surface arranged to engage the upper flange of the valve housing to support the valve housing.

20. The dispenser according to claim 1, wherein the pressure-actuated dispensing valve includes a plurality of deflectable fingers each having a protrusion thereon arranged to protrude into a flow path of topping through the pressure-actuated dispensing valve to form decorative ridges along a discharged ribbon of topping.

21. A dispenser system comprising:

(A) a refill package comprising a substantially rectangular-shaped plastic bag containing topping product to be dispensed therefrom, the bag including a neck portion at a lower corner thereof, and a discharge tip at a distal end of the neck portion; and (B) a refillable dispenser comprising:

a housing defining a product compartment for receiving the bag, the housing including a dispensing port communicating with the product compartment;

a dispensing valve assembly including a pressure-actuated dispensing valve aligned with the dispensing port of the housing, the dispensing valve assembly being adapted for coupling the dispensing tip of the bag thereto;

a pressure member in the product compartment;

a pressure surface proximate to the pressure member; and a carriage assembly connected to the pressure member for supporting and moving the pressure member relative to the pressure surface, the carriage assembly including a carriage and an electric motor operable to displace the carriage relative to the pressure surface;

(C) wherein movement of the pressure member relative to the pressure surface forces the product from the bag and through the dispensing valve.

22. The dispenser system according to claim 21, wherein the bag includes an upper seam defining a top marginal portion above the upper seam, wherein the topping product remains below the upper seam.

23. The dispenser system according to claim 22, wherein the marginal portion has a plurality of holes therethrough for use in suspending the bag.

* * * * *